US006084973A

United States Patent [19]

Green et al.

[11] Patent Number: 6,084,973

[45] Date of Patent: Jul. 4, 2000

[54] DIGITAL AND ANALOG DIRECTIONAL MICROPHONE

[75] Inventors: Jacquelynn Green; Robert T. Green, III, both of Akron; Tadashi Kikutani, Stow, all of Ohio

[73] Assignee: Audio Technica U.S., Inc., Stowe, Ohio

[21] Appl. No.: 08/995,714

[22] Filed: Dec. 22, 1997

[51] Int. Cl.[7] ..... H04R 3/00

[52] U.S. Cl. ..... 381/92; 381/94.7

[58] Field of Search ..... 381/92, 338, 356, 381/94.7, 94.1, 94.2

[56] References Cited

U.S. PATENT DOCUMENTS

| | | | |
|---|---|---|---|
| 4,555,598 | 11/1985 | Flanagan et al. | 381/338 |
| 4,723,294 | 2/1988 | Taguchi | 381/94.2 |
| 5,581,495 | 12/1996 | Adkins et al. | 381/94.7 |
| 5,715,319 | 2/1998 | Chu | 381/92 |
| 5,740,256 | 4/1998 | Castello Da Costa et al. | 381/94.7 |
| 5,825,898 | 10/1998 | Marash | 381/94.7 |

OTHER PUBLICATIONS

"Beamforming: A Versatile Approach to Spatial Filtering", Barry D. Van Veen and Kevin M. Buckley, ASSP Magazine, IEEE vol. 52, Apr. 1988, pp. 4–24.

*Primary Examiner*—Ping Lee
*Attorney, Agent, or Firm*—Welsh & Katz, Ltd.

[57] ABSTRACT

A directional microphone is disclosed. The shotgun microphone has an elongated tube which is designed to control directivity at frequencies above a predetermined frequency and at least four reference microphones spatially arranged about said shotgun microphone. A signal processor, which is electrically connected to said shotgun and reference microphones, generates interference cancelling signals from the portions of the signals from the reference microphones which have frequencies generally below the predetermined frequency. The signal processor combines the cancelling signals with the signal from the shotgun microphone to generate an output signal in which signals originating from in front of the directional microphone in a direction along the longitudinal axis of said tube are enhanced and signals originating from locations other than in front of the directional microphone in a direction along the longitudinal axis of said tube are suppressed.

14 Claims, 9 Drawing Sheets

DIGITAL AND ANALOG DIRECTIONAL MICROPHONE

BACKGROUND OF THE INVENTION

The present invention generally relates to directional microphones and, more particularly, to a directional microphone having a minimized self noise level in order to achieve improved dynamic range performance.

Directional microphones are widely used in the professional market for various applications such as news gathering, sporting events, outdoor film recording, and outdoor video recording. The use of directional microphones in these types of situations is a necessity where noise is present and there is no practical way to place the microphone in close proximity to the audio source.

Two kinds of directional microphones are in use today. The first type of directional microphone is called a shotgun microphone which is also known as a line plus gradient microphone. Shotgun microphones typically comprise an acoustic tube that by its mechanical structure reduces noises that arrive from directions other than directly in front of the microphone along the axis of the tube. The second type of directional microphone is a parabolic dish that concentrates the acoustic signal from one direction by reflecting away other noise sources that are in a direction away from the desired direction.

Both of these types of microphones have a fixed directionality which provides good noise reduction from a direction in back of the microphone. However, typical directional microphones suffer from a number of disadvantages such as poor noise reduction for noise sources in front of the microphone, less than impressive noise reduction performance in low frequency bands such as those of a speech signal (which typically are on the order of 300–500 Hz), and colorization problems created by the tight dependency of the microphone's directionality in frequency. Thus, the frequency response of the microphone at "off axis" angles becomes irregular and the output may sound odd.

Microphone arrays (typically comprising five or eleven elements which are acoustically summed using analog technology) may be used to provide a directional pick-up pattern similar to a shotgun microphone or parabolic dish. In these types of microphones, the directionality is fixed, and the frequency response is, by mathematical definition, limited to a range from 500–5,000 Hz. The only way to improve the performance of this type of microphone is to increase the physical size of the array or utilize more individual microphones in the array. Due to the frequency response limitation which interferes with and cuts off the reception of speech signals, shotgun or parabolic microphones typically are preferred.

Hand-held microphones may be used for interview purposes. An important criteria for this application is the rejection of unwanted background noise, especially when the interview is conducted outside where various noise sources may be present in addition to the desired target source. While shotgun or parabolic microphones allow background noise to be rejected, these devices are impractical for use in an interview situation due to their large size, awkward performance at close range, and difficulties associated with holding the device.

Digital technology offers a technique known as beamforming in which signals from an array of spatially distributed sensor elements are combined in a way to enhance the signals coming from a desired direction while suppressing signals coming from directions other than the desired direction. This has the capability of providing the same directionality as would be provided by an analog microphone with the same size as the sensor array. In general, there are two beamforming techniques which are discussed in greater detail hereafter.

First, a non-adaptive beamformer may include a filter having a number of predetermined coefficients which allows the beamformer to exhibit maximum sensitivity or minimum sensitivity (a null) along a desired direction. The performance of a non-adaptive beamformer is limited because the predetermined filter coefficients do not allow nulls to be placed in the direction of interferences that may exist or to be moved about in a dynamically changing environment. Second, an adaptive beamformer includes a filter having coefficients that are continuously updated to allow the beamformer to adapt to the changing location of a desired signal in a dynamically changing environment. Thus, adaptive beamformers allow nulls to be placed in accordance with the movement of noise sources in a changing environment.

While adaptive beamformers provide significant advantages over a comparable analog device, adaptive beamforming devices are limited in resolution, dynamic range, and signal to noise ratio and are difficult to incorporate in and utilize with a directional microphone such as a shotgun microphone.

BRIEF SUMMARY OF THE INVENTION

One of the primary objects of the present invention is to provide a digital and analog directional microphone which utilizes an adaptive beamformer, has a minimized self noise level in order, for example, to achieve the greatest dynamic range performance, and is easily used.

A directional microphone according to the invention comprises: a shotgun microphone having an elongated tube which is designed to control the directivity of said directional microphone at frequencies above a predetermined frequency; at least four reference microphones spatially arranged about said shotgun microphone; and a signal processor electrically connected to said shotgun and reference microphones, said signal processor generating interference cancelling signals from the portions of the signals from said reference microphones which have frequencies generally below said predetermined frequency, said signal processor combining said cancelling signals with the signal from said shotgun microphone to generate an output signal in which signals originating from in front of the directional microphone in a direction along the longitudinal axis of said tube are enhanced and signals originating from locations other than in front of the directional microphone in a direction along the longitudinal axis of said elongated tube are suppressed.

Other objects of the invention include, for example, providing a digital and analog directional microphone that provides improved target signal resolution as well as improved target signal to noise ratio.

DETAILED DESCRIPTION

Figure 1B:
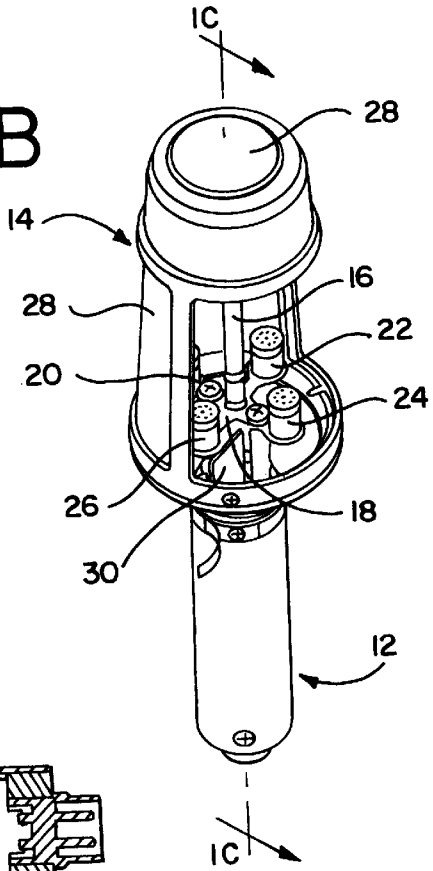
FIGS. 1A, 1B and 1C are a perspective and a perspective cutaway view of a digital and analog directional microphone according to the present invention.
Figure 1A:
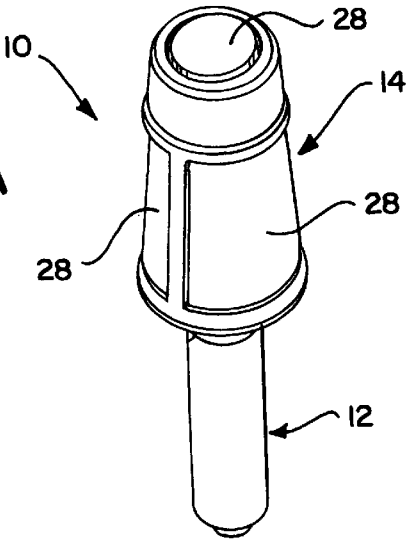
Figure 1C:
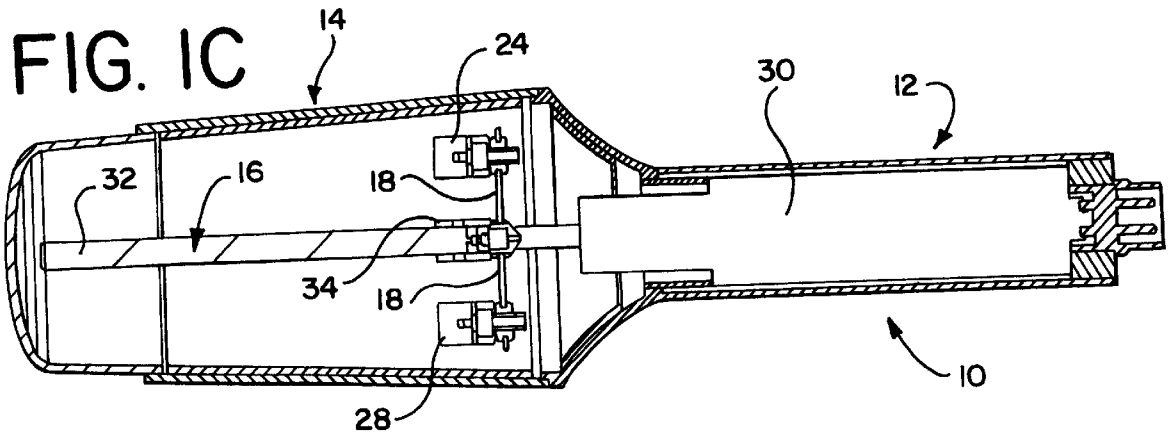

Referring to FIGS. 1A–1C, a number of perspective and cut-away views of a digital and analog directional microphone 10 according to the present invention are shown. Microphone 10 includes a handle portion 12 and a sensor portion 14. A shotgun microphone 16 is mounted on bracket 18 inside the sensor portion 14 of microphone 10. Four cardoid reference microphones 20, 22, 24, and 26 are mounted on bracket 18 and are spatially arranged about the longitudinal axis of shotgun microphone 16. The sensor portion 14 includes three fabric portions 28 or other suitable sound permeable material that allow the shotgun microphone 16 and reference microphones 20–26 to receive signals from a target source located in front of microphone 10 along the longitudinal axis of microphone 16. Portions 28 also allow the reference microphones 20–26 to receive interference signals which originate from various noise sources that are located off-axis relative to microphone 10 along directions other than the longitudinal axis of shotgun microphone 16. Microphone 10 also includes a printed circuit board 30 which is mounted within handle portion 12 and includes circuitry disposed thereon as discussed in greater detail hereafter.

Shotgun microphone 16 includes an elongated tube portion 32 and a base portion 34 attached to bracket 18 as shown in FIG. 1B. The length of interference tube 32 controls the directivity pattern of shotgun microphone 16. Typically, shotgun microphones having relatively long tube portions are designed to work down to frequencies from about 200 to 300 Hz. However, the length of the tube portion creates undesired lobes in higher frequencies. In other words, the longer the tube, the lower the frequency at which the undesired lobes begin to manifest themselves. Because an adaptive algorithm is used to control the directivity below 3 kHz, the length of tube portion 32 is chosen to allow the directivity of shotgun microphone 16 to be controlled by the tube portion 32 itself at or above a frequency of 3 kHz. The directivity pattern of tube portion 32 degrades to a standard first order pressure plus gradient pattern below this frequency. Preferably, tube portion 32 is approximately 5 inches long which allows, for example, microphone 10 to be conveniently used for interview purposes.

Figure 2:
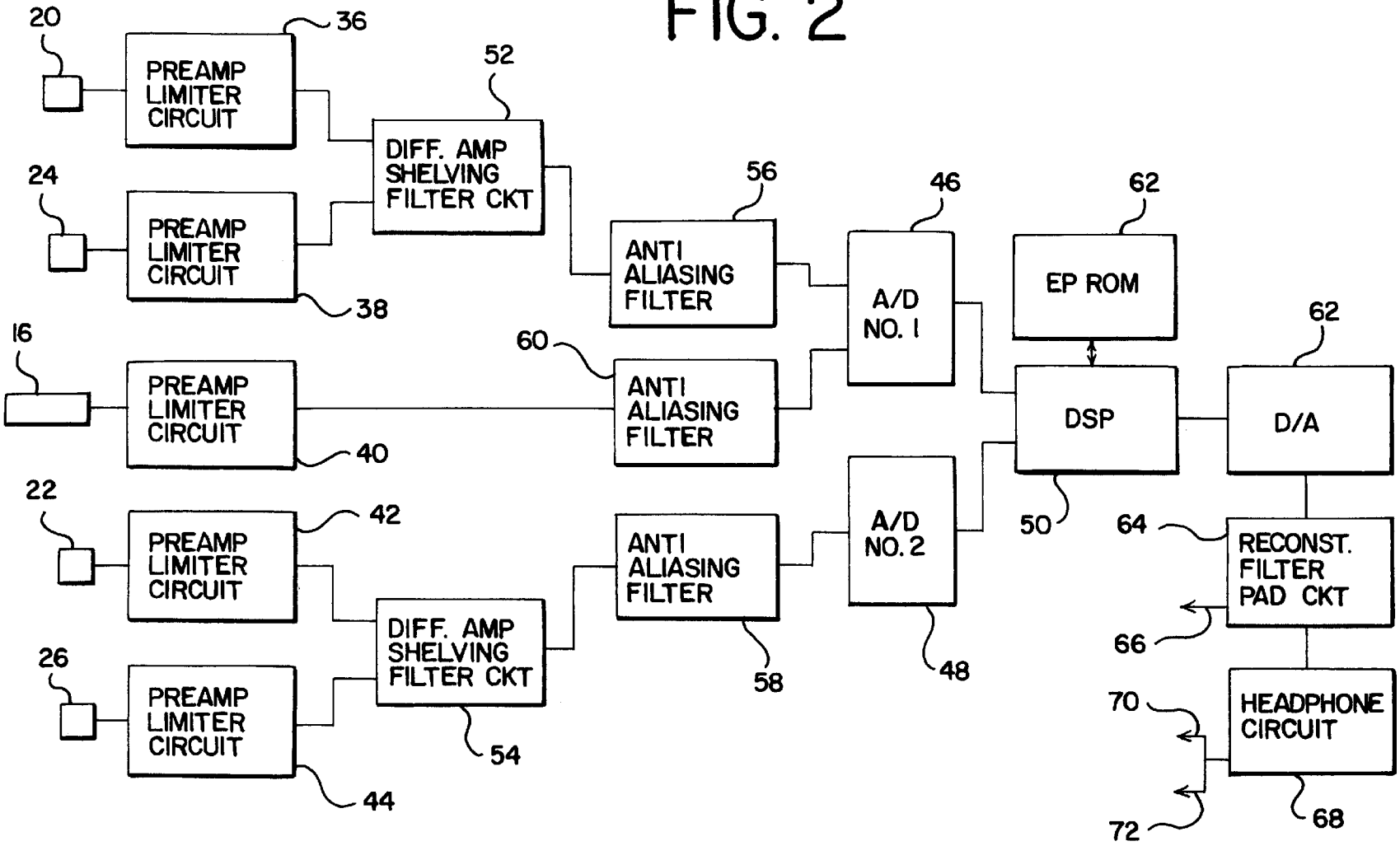
FIG. 2 is a schematic, block diagram of the circuitry used in the digital and analog directional microphone shown in FIGS. 1–1B.
Figure 4A:
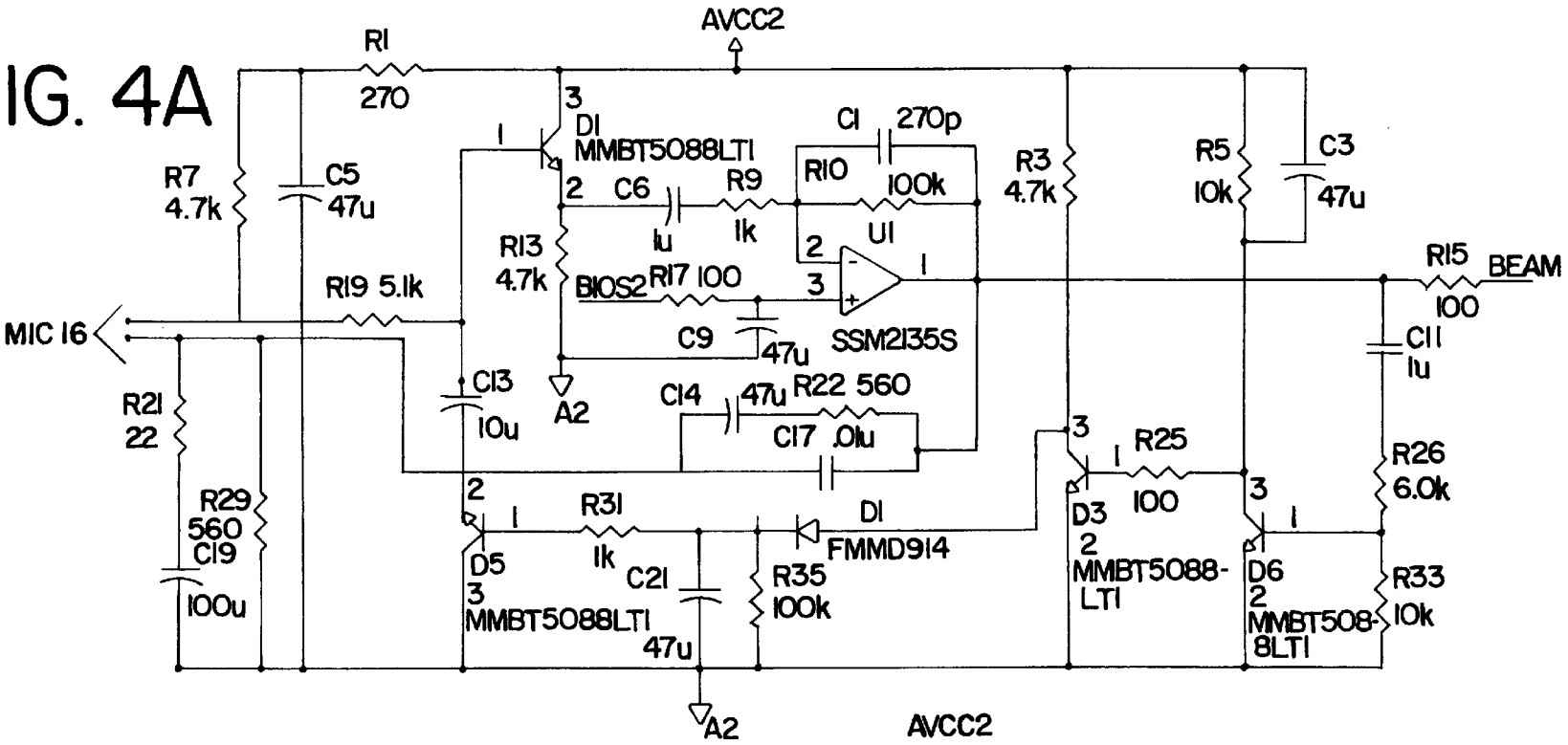
FIG. 4A is a schematic diagram of a preamplifier and limiter circuit which is used to amplify and limit the signal from the shotgun microphone shown in FIG. 2.
Figure 4B:
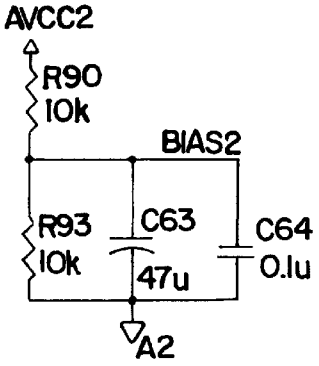
FIG. 4B is a schematic diagram of a bias circuit which provides a bias voltage that is supplied to the circuit shown in FIG. 4A.

FIG. 2 is a schematic, block diagram of the circuitry that is used in microphone 10 and is mounted on circuit board 30. Shotgun microphone 16 and reference microphones 20–26 are connected to preamplifier and limiter circuits 36–44 as shown. Circuits 36–44 are equivalent and include a low noise preamplifier having a gain structure which is designed such that the gain of the preamplifier is set to a level which puts the self noise of the microphones at a level just below the noise threshold of the analog to digital (A/D) converters provided in circuits 46 and 48. FIGS. 4A and 4B illustrate a preferred embodiment of a preamplifier and limiter circuit which is connected to shotgun microphone 16. As readily apparent to one of ordinary skill in the relevant art, other circuits may be utilized.

A typical shotgun microphone has a dynamic range of about 112 decibels or greater which arises from the shotgun microphones self-noise specification of 12 DB SPL and maximum SPL capability of 124 db SPL. These specifications are necessary in shotgun microphone applications due to the need to pick up sounds at a great distance as well as the need to minimize distortion when the microphone 10 is used near large sound fields. Minimizing the self-noise level allows the greatest dynamic range performance to be achieved.

The analog to digital converter used in circuits 46 and 48 preferably utilizes 16 bits which provides a dynamic range of 98 dB. In order to increase the apparent dynamic range, an output level limiter is placed in each of the circuits 36–44. Each limiter gives approximately 17 decibels of limiting action which increases the dynamic range of the analog to digital converters to an apparent dynamic range of 115 decibels. The utilization of output level limiters is preferred because, for example, while the dynamic range could be increased by using a greater number of bits in the analog to digital conversion process, processing a greater number of bits in the digital signal processor 50 correspondingly increases computational complexity and limits the amount of processing time possible for each sample.

Figure 5A:
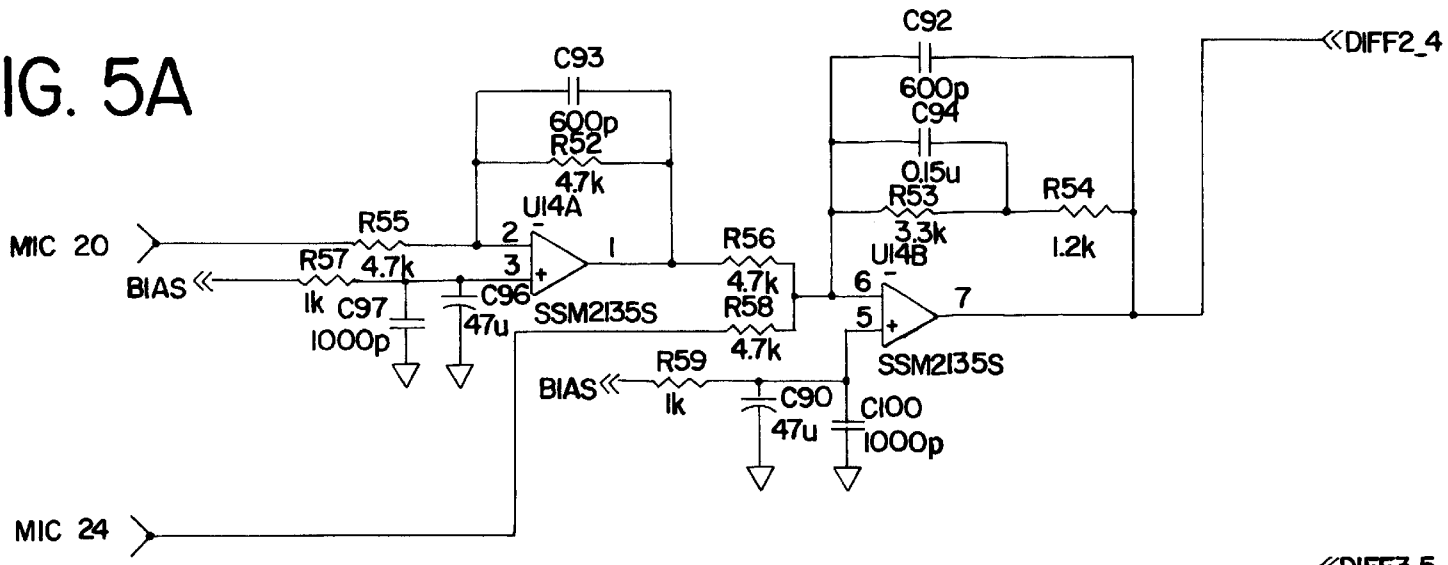
FIGS. 5A and 5B are schematic diagrams of the different amplifier and shelving circuits shown in FIG. 2.
Figure 5B:
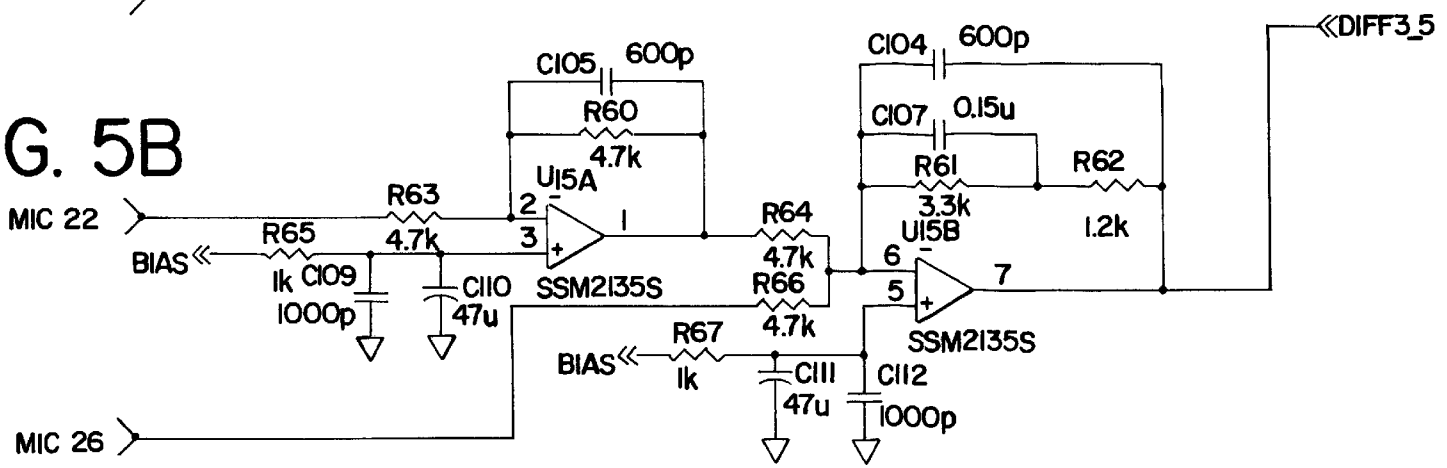

Difference amplifier and shelving filter circuits 52 and 54 are electrically connected to an output of preamplifier and limiter circuits 36/38 and 42/44 are supplied to, respectively. Circuit 52 generates a signal which is equal to the signal from the microphone 20 minus the signal from the microphone 24. Circuit 54 creates a signal which is equal to the signal from microphone 22 minus the signal from microphone 26. Both of the circuits 52 and 54 perform a shelving filter function which boosts the lower frequency signals by 1.5 dB which is advantageous for adaptive beamforming purposes as discussed in greater detail hereafter. The 1.5 dB of boost is created by reducing the output of the higher frequency signals which means that low frequency signals are passed at unity gain and higher audio frequency signals are reduced in magnitude by 1.5 dB. FIGS. 5A and 5B illustrate a preferred embodiment of difference amplifier and shelving filter circuits 52 and 54. As readily apparent to one of ordinary skill in the relevant art, other circuits may be utilized.

Figure 6A:
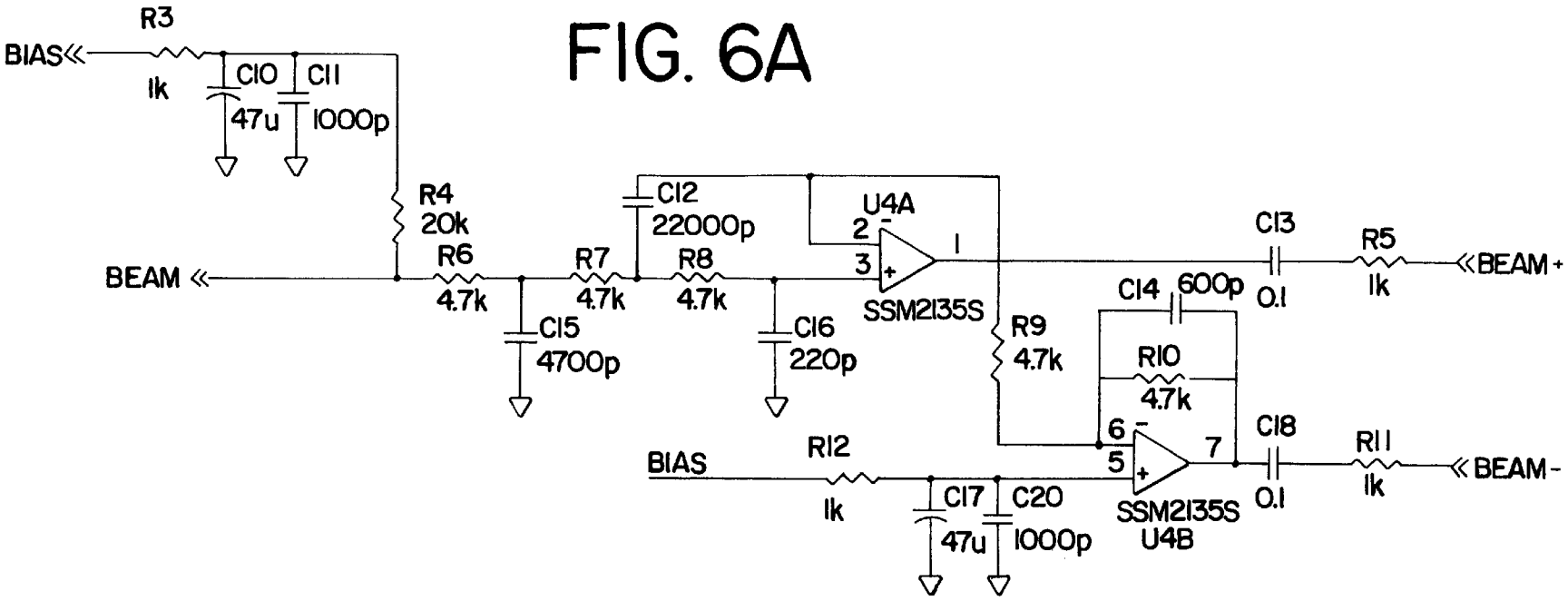
FIG. 6A is a schematic diagram of an anti-aliasing filter that processes the beam signal from the preamp and limiter circuit shown in FIG. 2.
Figure 6B:
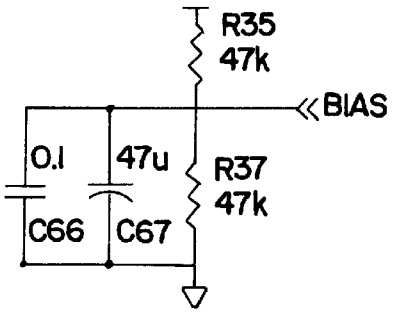
FIG. 6B is a schematic diagram of a bias circuit which provides a bias voltage to the circuit shown in FIG. 6A.

The signals from differential amplifier shelving filter circuits 52 and 54 and the signal from preamplifier limiter circuit 40 are supplied to anti-aliasing filter circuits 56–60 as shown in FIG. 2. In the preferred embodiment, each filter comprises a third order 18 dB/octave anti-aliasing filter which is centered at 15 kHz. FIGS. 6A and 6B illustrate a preferred embodiment of anti-aliasing filter circuits 56–60 and, as readily apparent to one of ordinary skill in the relevant art, other circuits may be utilized.

Filter circuits 56 and 60 are connected to an analog to digital converter circuit 46 and filter circuit 58 is connected to analog to digital converter circuit 48. Converter circuits 46 and 48 include 64× over-sampling Sigma-Delta converters, a signal balancer, and a 16 bit analog to digital converter. The Delta-Sigma converter, in conjunction with the anti-aliasing filter circuits 56–60, allows aliasing-type noise to be maintained at a level below the noise floor of the analog to digital converter. The output signal from each Sigma-Delta converter is balanced by the signal balancer with the resulting signal being applied to a separate analog to digital converter.

Figure 7:
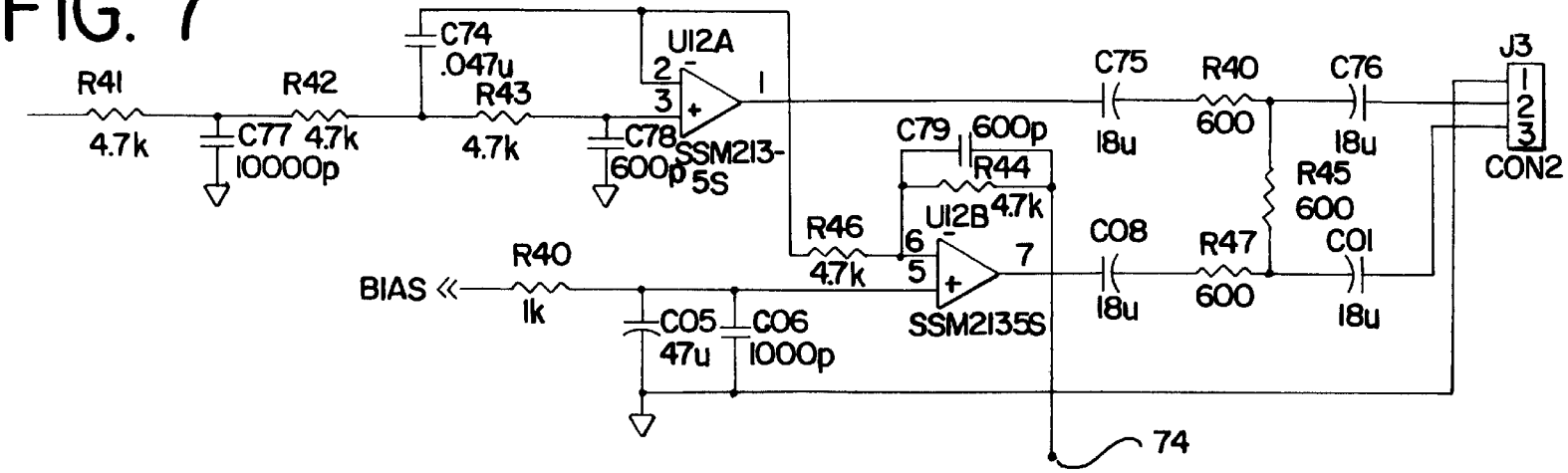
FIG. 7 is a schematic diagram of a reconstruction filter and pad shown in FIG. 2.
Figure 8:
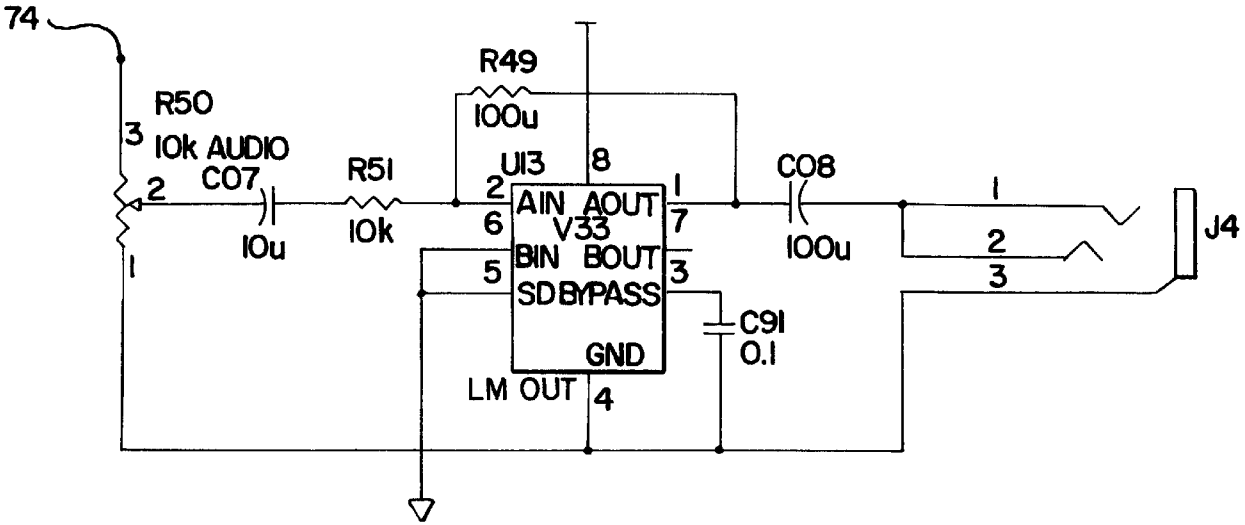
FIG. 8 is a schematic diagram of the headphone circuit shown in FIG. 2.
Figure 9:
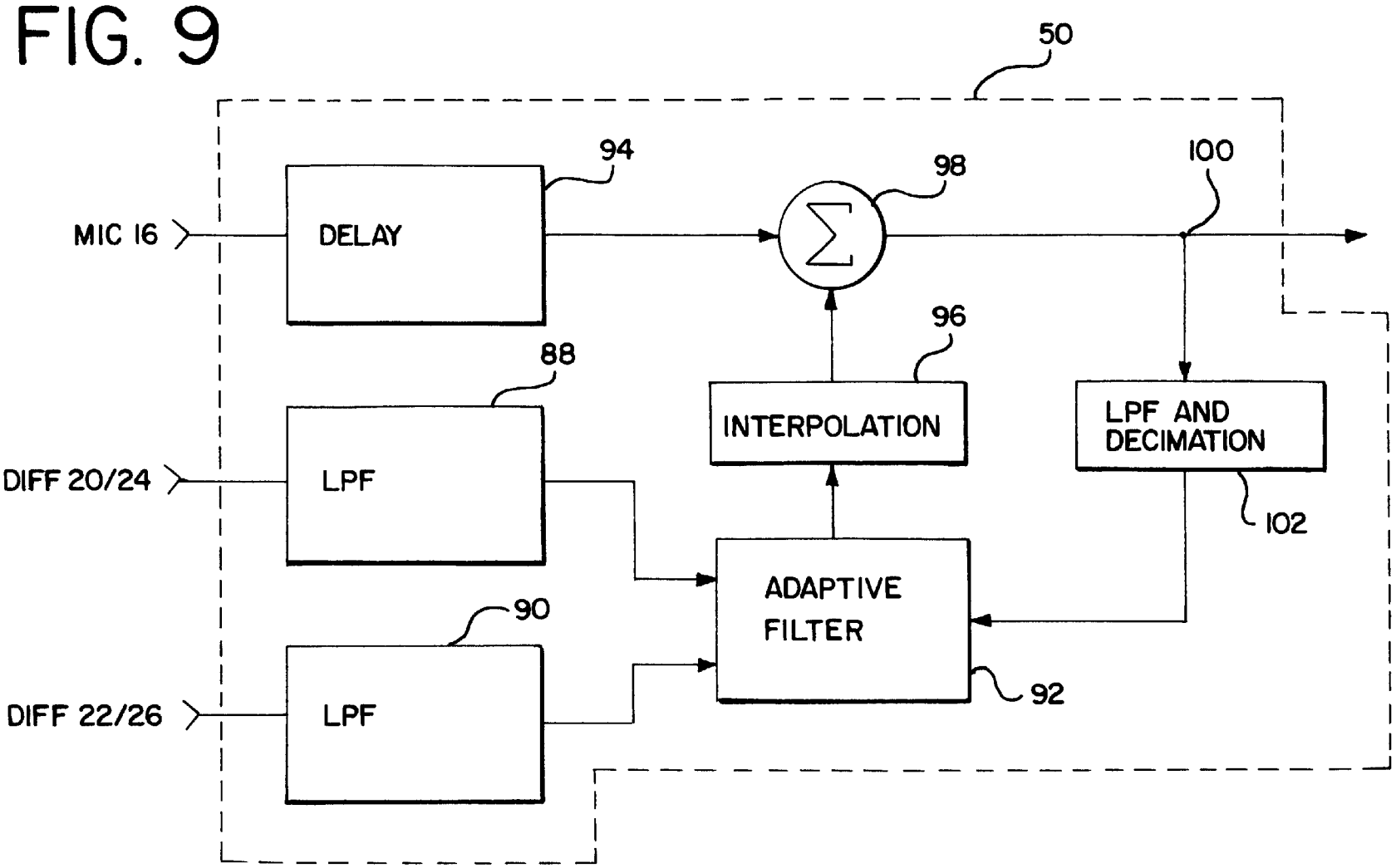
FIG. 9 is a block diagram which illustrates one method of operation of the digital signal processor shown in FIG. 2.

Digital versions of the output signals from filter circuits 56–60 are applied to a digital signal processor ("DSP") 50. DSP 50 is operatively coupled to an EPROM 62 to allow adaptive beamforming to take place as discussed in greater detail hereafter with reference to FIG. 9. DSP 50 is connected to a reconstruction filter and pad circuit 64 via digital to analog converter 62. Circuit 62 includes a 10 decibel pad circuit which brings the level of the output signal down to a standard microphone output at terminal 66. A headphone circuit 68 is connected to reconstruction filter and pad circuit 64 to allow a user to listen to the output of the digital and analog microphone 10 on outputs 70 and 72. A preferred embodiment for circuits 64 and 68 are shown in FIGS. 7 and 8. Note that the circuits shown in FIGS. 7 and 8 are electrically connected together at note 74. As readily apparent to one of ordinary skill in the art, other embodiments of circuits 64 and 68 may be used.

Figure 3A:
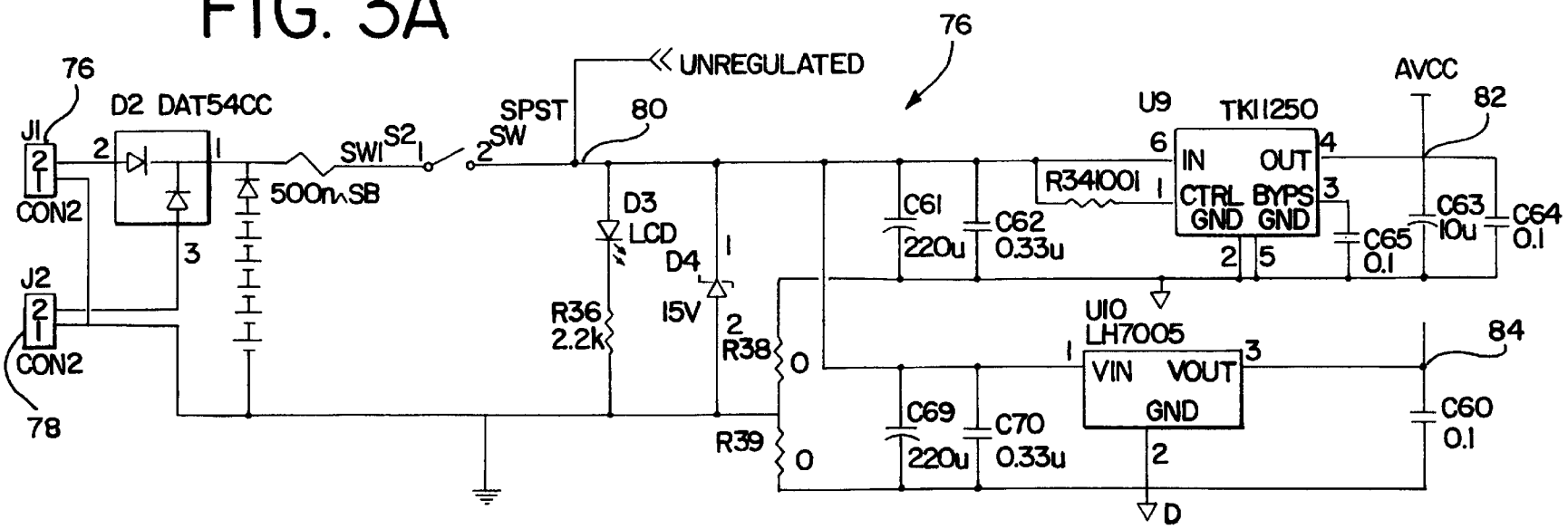
FIGS. 3A and 3B are schematic diagrams of the power supply circuitry that provides low-noise power to the circuitry shown in FIG. 2.
Figure 3B:
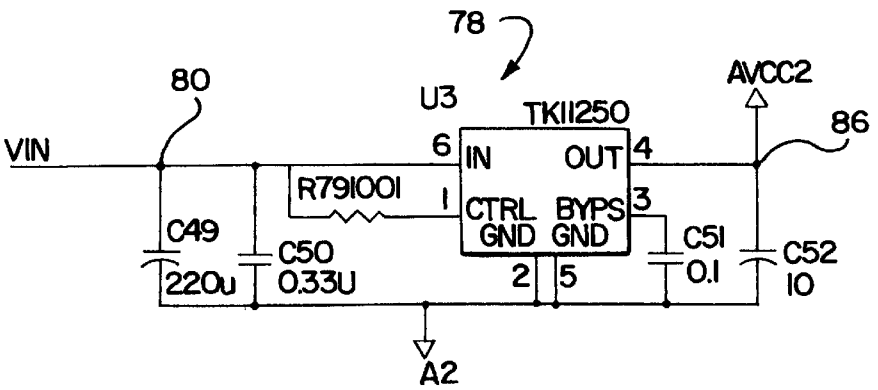

FIGS. 3A and 3B illustrate circuitry for supplying power to the circuitry shown in FIGS. 4A through 8. Microphone 10 can be connected to an external power supply such as, for example, a portable video camera battery by connectors 76 and 78. However, it should be appreciated that the individual components of the circuitry shown in FIGS. 4A–8 may be selected to minimize current drain to allow, for example, the circuitry to be run on six external AA batteries (not shown) for portable field applications. Note that circuit 76 is electrically connected to circuit 78 at common node 80. Thus, circuits 76 and 78 provide three separate voltages at nodes 82, 84, and 86 for supplying power to the circuitry shown in FIGS. 4A–8.

A preferred method by which DSP 50 may performs adaptive beamforming is discussed hereafter. Analog to digital converter circuits 46 and 48 periodically supply digital samples of the reference microphone difference signals from filters 56 and 58 (microphones 20/24 and 22/26) to low-pass filters 88 and 90. Filters 88 and 90 are designed to attenuate and filter out all frequencies contained in the difference signals which are above the frequency at which the tube portion 32 is designed to control the directivity of shotgun microphone 16. In the preferred embodiment, filters 88 and 90 remove difference signals having frequencies of 3 kHz and above. The filtered signals from filters 88 and 90 represent interference signals received from all directions other than the desired direction in which shotgun microphone 16 is pointed and are applied to an adaptive filter 92.

Adaptive filter 92 processes the signals from filters 88 and 90 and generates low-frequency cancelling signals which generally represent the interference present in a low-frequency portion of the signal from shotgun microphone 16 that is periodically stored in delay circuit 94. Interpolator 96 converts the low-frequency cancelling signals from adaptive filter 92 into broadband signals. Summer circuit 98 is utilized to subtract the cancelling signals from the signals stored in delay circuit 94 and apply the output signal at node 100 which is electrically connected to digital to analog converter circuit 62. The signal at node 100 is processed by low-pass filter and decimation circuit 102 and is fed back to adaptive filter 92.

EPROM 62 may contain different programs for controlling the adaptive beamforming operation of DSP 50. Each different program may be selected by a user by means of a switch (not shown) that may be provided on the handle portion 12 of microphone 10. For example, movement of the switch would allow a user to change the program parameters in order to modify the amount of directivity below 3 kHz or to allow only the signal from shotgun microphone 16 to be passed without the adaptive beamforming process of the DSP 50. In this regard, a second method by which digital signal processor 50 shown in FIG. 2 may perform adaptive beamforming is discussed with reference to FIG. 10 hereafter.

Figure 10:
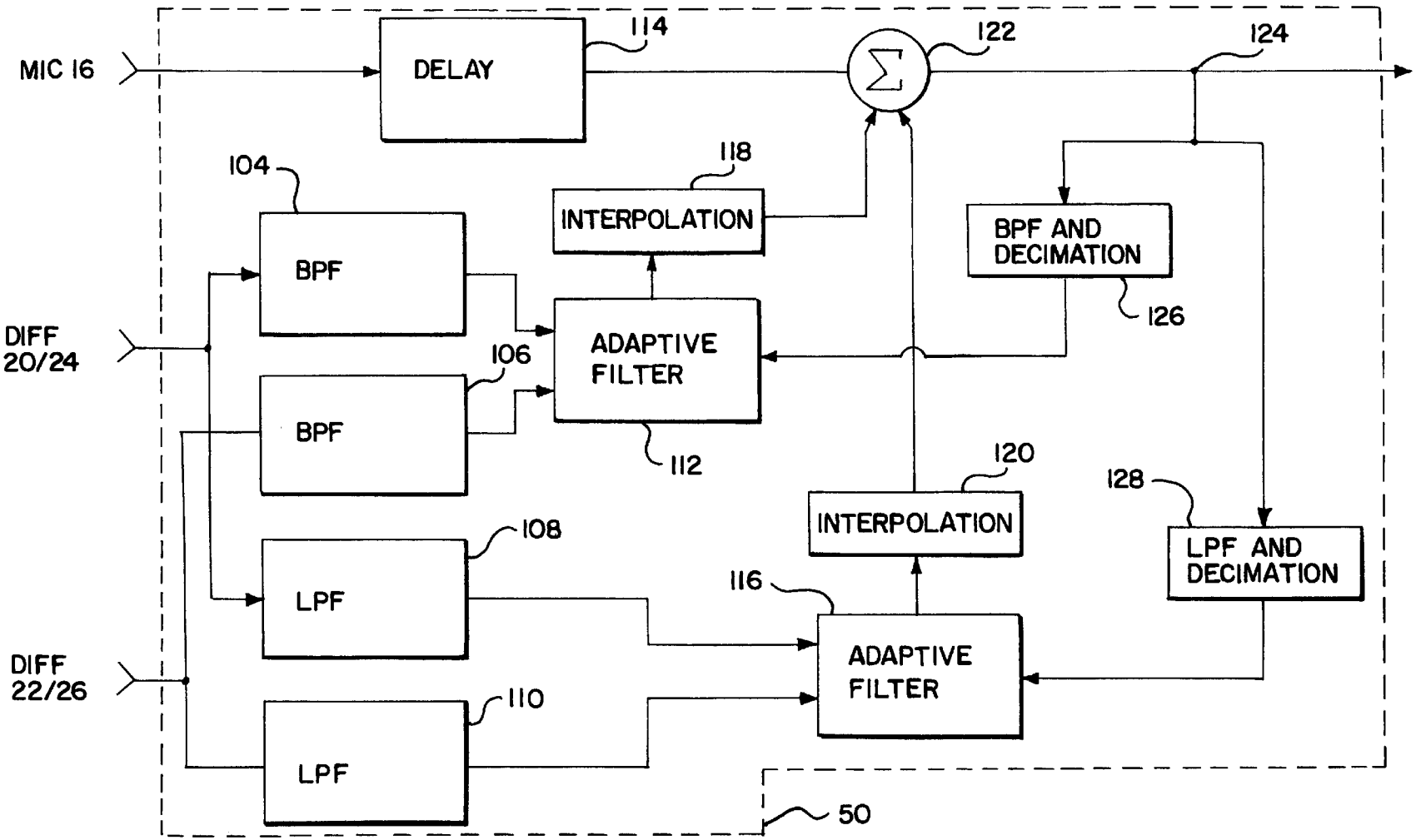
FIG. 10 is a block diagram which illustrates a second method of operation of the digital signal processor shown in FIG. 2.

Referring to FIG. 10, A/D circuits 56 and 58 periodically supply digital samples of the reference microphone difference signals from filters 56 and 58 (microphones 20/24 and 22/26) to band-pass filters 104 and 106 as well as low-pass filters 108 and 110. Band-pass filters 104 and 106 are designed to allow a signal frequency band from the frequency at which the tube portion 32 is designed to control the directivity of shotgun microphone 16 down to a lower frequency. Low-pass filters 108 and 110 are designed to attenuate and filter out all frequencies which are above the above-referenced "lower" frequency.

Adaptive filter 112 processes the band-pass signals from filters 104 and 106 and generates band-pass frequency cancellation signals which generally represent the interference present in the band-pass portion of the signal from shotgun microphone 16 that is periodically stored in delay circuit 114. Adaptive filter 116 processes the low-frequency signals from fitlers 108 and 110 which generally represent the interference present in the low-frequency portion of the signal from shotgun microphone 16. Interpolators 118 and 120 convert the band-pass and low-frequency signals from adaptive filters 112 and 116, respectively, into broadband signals. Summer circuit 122 is utilized to subtract the cancelling signals from interpolators 118 and 120 from the signals from shotgun microphone 16 that are periodically stored in delay circuit 114. The output of summer circuit 122 is applied to a node 124 which is electrically connected to digital to analog converter circuit 62. The signal present at node 124 is fed back to adaptive filter 112 via band-pass filter and decimation circuit 126 and is fed back to adaptive filter 116 via low-pass filter and decimation circuit 128.

While the invention has been illustrated and described in detail in the drawings and foregoing description, the same is considered illustrative and not restrictive in character, it being understood that only the preferred embodiments have been shown and described and that all changes and modifications that come within the spirit of the invention are desired to be protected.

What is claimed is:

1. A directional microphone, comprising:

a shotgun microphone having an elongated tube which is designed to control the directivity of said directional microphone at frequencies above a predetermined frequency, said elongated tube causing the portion of an output signal from said shotgun microphone and the directional microphone at frequencies above said predetermined frequency to be generally representative of the portion of the signals at frequencies above said predetermined frequency which originate from a location in front of said directional microphone in a direction along the longitudinal axis of said elongated tube;

at least two reference microphones spatially arranged about said shotgun microphone;

a low-pass filter electrically connected to said reference microphones, said low-pass filter generating an output signal having a frequency generally below said predetermined frequency; and a signal processor electrically connected to said shotgun and reference microphones and said low-pass filter, said signal processor generating interference canceling signals from the output signal of said low-pass filter, said signal processor combining said canceling signals with the output signal from said shotgun microphone to generate an output signal in which signals originating from the location in front of the directional microphone in a direction along the longitudinal axis of said tube are enhanced and signals originating from locations other than in front of the directional microphone in a direction along the longitudinal axis of said elongated tube are suppressed.

2. The directional microphone of claim 1 wherein the directional microphone includes at least four reference microphones.

3. The directional microphone of claim 2 wherein said signal processor combines the output signals of said at least four reference microphones to form at least two reference microphone difference signals, said signal processor generating said cancelling signals from the portions of said difference signals which have frequencies generally below said predetermined frequency.

4. The directional microphone of claim 1 wherein said signal processor includes a preamplifier and limiter circuit electrically connected to each one of said shotgun and reference microphones and an analog to digital conversion circuit electrically connected to each one of said preamplifier and limiter circuits, each one of said preamplifier and limiter circuits having gain and limiter parameters which are balanced to allow a noise floor and dynamic range of said shotgun and reference microphones to matched to a noise floor and dynamic range of said analog to digital conversion circuits.

5. The directional microphone of claim 1 wherein said signal processor includes a filter circuit and an analog to digital conversion circuit electrically connected to each one of said shotgun and reference microphones, said filter circuits allowing aliasing type noise to be reduced to a level below a noise threshold of said analog to digital conversion circuit corresponding thereto.

6. The directional microphone of claim 5 wherein each of said filter circuits comprise an anti-aliasing filter and an over-sampling Sigma-Delta converter.

7. The directional microphone of claim 1 wherein said signal processor includes an adaptive beamformer.

8. The directional microphone of claim 1 wherein said signal processor creates at least two sets of cancelling signals from individual portions of said reference microphone signals which have frequencies generally below said predetermined frequency.

9. The directional microphone of claim 1 wherein said predetermined frequency is approximately 3 kHz.

10. The directional microphone of claim 1 wherein said signal processor includes an output level limiter circuit coupled to each one of said shotgun and reference microphones and an analog to digital converter circuit coupled to each one of said output level limiting circuits, said analog to digital conversion circuits providing a predetermined maximum dynamic range, wherein said output level limiter circuits reduce the level of the output signals from said shotgun and reference microphones by a predetermined amount to allow the apparent dynamic range to be increased.

11. The directional microphone of claim 10 wherein said maximum dynamic range is approximately 95 dB and said limiter circuits reduce signal levels by approximately 17 dB to provide an apparent dynamic range of 112 dB.

12. The directional microphone of claim 1 wherein a shelving filter circuit is coupled to each one of said at least two reference microphones, said shelving filter circuits boosting a portion of the output signal from the reference microphone corresponding thereto which is below a certain frequency.

13. The directional microphone of claim 12 wherein each of said shelving circuits boosts a portion of the output signal from the reference microphone corresponding thereto by reducing the portion of said output signals above said certain frequency.

14. The directional microphone of claim 1 wherein said elongated tube is approximately five inches in length.

* * * * *

US006084973C1

(12) EX PARTE REEXAMINATION CERTIFICATE (5275th)

United States Patent
Green et al.

(10) Number: US 6,084,973 C1
(45) Certificate Issued: Feb. 21, 2006

(54) DIGITAL AND ANALOG DIRECTIONAL MICROPHONE

(75) Inventors: Jacquelynn Green, Akron, OH (US); Robert T. Green, III, Akron, OH (US); Tadashi Kikutani, Stow, OH (US)

(73) Assignee: Audio-Technica U.S., Inc., Sowe, OH (US)

Reexamination Request:
No. 90/006,074, Jul. 31, 2001

Reexamination Certificate for:

| | |
|---|---|
| Patent No.: | **6,084,973** |
| Issued: | **Jul. 4, 2000** |
| Appl. No.: | **08/995,714** |
| Filed: | **Dec. 22, 1997** |

(51) Int. Cl.
*H04R 3/00* (2006.01)

(52) U.S. Cl. ..... 381/92; 381/94.7
(58) Field of Classification Search ..... 381/92, 381/91, 122, 94.1, 94.2, 94.3, 94.7, 338, 381/356
See application file for complete search history.

(56) References Cited

U.S. PATENT DOCUMENTS 5,500,902 A * 3/1996 Stockham, Jr. et al. ..... 381/106
6,178,248 B1 1/2001 Marash ..... 381/94.2

* cited by examiner

*Primary Examiner*—Xu Mei

(57) ABSTRACT

A directional microphone is disclosed. The shotgun microphone has an elongated tube which is designed to control directivity at frequencies above a predetermined frequency and at least four reference microphones spatially arranged about said shotgun microphone. A signal processor, which is electrically connected to said shotgun and reference microphones, generates interference cancelling signals from the portions of the signals from the reference microphones which have frequencies generally below the predetermined frequency. The signal processor combines the cancelling signals with the signal from the shotgun microphone to generate an output signal in which signals originating from in front of the directional microphone in a direction along the longitudinal axis of said tube are enhanced and signals originating from locations other than in front of the directional microphone in a direction along the longitudinal axis of said tube are suppressed.

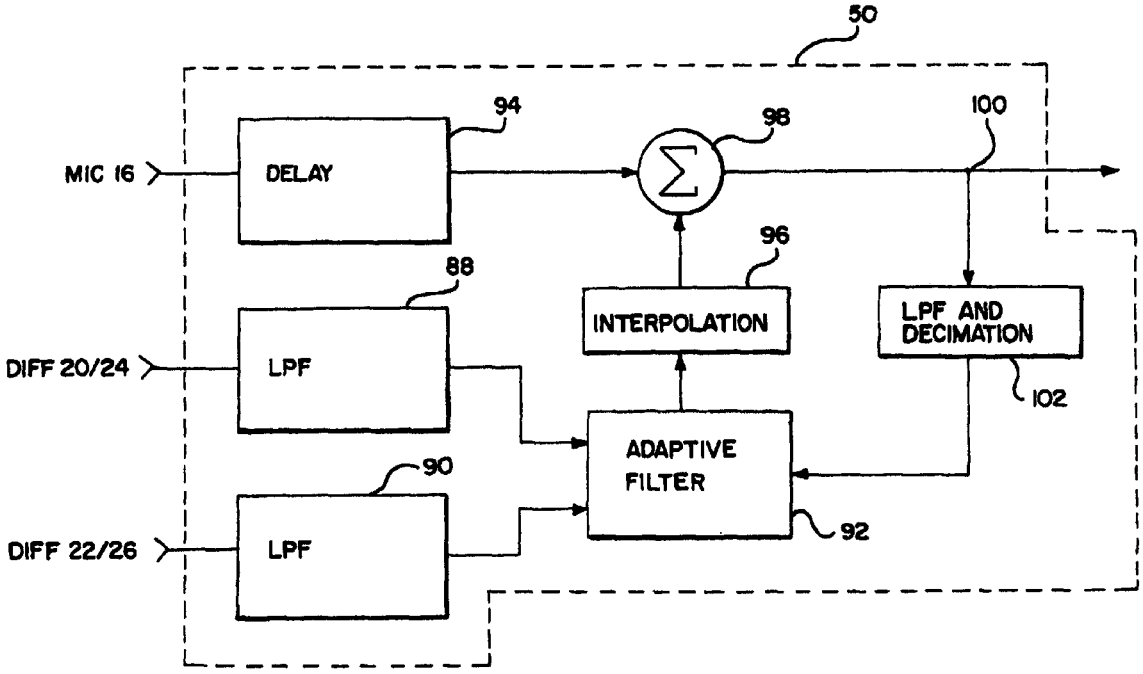

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–14 is confirmed.

* * * * *